US006439737B1

(12) United States Patent
Lin et al.

(10) Patent No.: US 6,439,737 B1
(45) Date of Patent: Aug. 27, 2002

(54) STRUCTURE OF FLASH MOVABLE DECORATING LAMP

(76) Inventors: Leo Lin, 3F, No. 123, Wuchiuanshi 5th St., Taichung (TW); Chin Yung Hsu, 4F, No. 7, Lane 10, Sec. 3, Hsin Sheng S. Rd., Taipei (TW)

( * ) Notice: Subject to any disclaimer, the term of this patent is extended or adjusted under 35 U.S.C. 154(b) by 0 days.

(21) Appl. No.: 09/585,794

(22) Filed: Jun. 5, 2000

(51) Int. Cl.[7] ..... F21L 7/00

(52) U.S. Cl. ..... 362/158; 362/362; 362/184; 362/219; 362/222; 362/223; 362/238

(58) Field of Search ..... 362/184, 219, 362/238, 158, 222, 223

(56) References Cited

U.S. PATENT DOCUMENTS 5,081,568 A * 1/1992 Dong et al. ..... 362/184
5,117,341 A * 5/1992 Huang ..... 362/184
5,331,528 A * 7/1994 Chen ..... 362/205
5,697,695 A * 12/1997 Lin et al. ..... 362/184
5,848,836 A * 12/1998 Graber et al. ..... 362/223
5,964,518 A * 10/1999 Shen ..... 362/225
6,012,824 A * 1/2000 Sharrah et al. ..... 362/199
6,099,142 A * 8/2000 Liu ..... 362/191
6,120,163 A * 9/2000 Grabet et al. ..... 362/223
6,179,431 B1 * 1/2001 Chien ..... 362/84
6,213,623 B1 * 4/2001 Campman ..... 362/202

* cited by examiner

*Primary Examiner*—Sandra O'Shea
*Assistant Examiner*—Anabel Ton
(74) *Attorney, Agent, or Firm*—Rosenberg, Klein & Lee

(57) ABSTRACT

A structure of a flash movable decorating lamp comprises at least one first unit and at least one second unit. Each first unit is formed by a hollow tube with a high pressure converting circuit and an actuation circuit, stopping rings, rubber water-proof rings, plastic male threaded tube seats, connector fixing seats, water-proof rubber rings, a male threaded tube seat for assisting in fixing, connecting line fixing sleeves, a female threaded tube seat for assisting in fixing, a connector male seat, and plastic female threaded tube seats, etc. Each second unit is formed by a transparent tube with movable decorating lamp flash circuit, a plastic male threaded tube seat assisting a fixing, a connector fixing seat, a water-proof rubber ring, a male threaded tube seat for assisting in fixing, a connecting line fixing sleeve, a female threaded tube seat for assisting in fixing, a connector male seat, and a plastic female threaded tube seat, etc., thereby, no screw is necessary in fixing. A structure of a flash movable decorating lamp is formed, by which, a flash circuit can be detachably attached thereto, and a serial system or a serial and parallel system with many variation can be formed. Many variations in controlling with very complex patterns can be achieved.

7 Claims, 10 Drawing Sheets

STRUCTURE OF FLASH MOVABLE DECORATING LAMP

FIELD OF THE INVENTION

The present invention relates to a structure of a flash movable decorating lamp, and especially to a structure by which a flash circuit board can be detached or attached conveniently.

BACKGROUND OF THE INVENTION

In the conventional flash circuit board, if it is to have the function of sequential actions of a movable decorating lamp, other than a circuit unit comprising the original high pressure converting circuit 60, a high voltage storage capacitor 65, a triggering circuit 70, a flash lamp tube 75 and a high voltage triggering coil 80, as shown in FIG. 1, a further movable decorating lamp sequential control circuit is necessary (including a N loop movable decorating lamp sequential control circuit and movable decorating lamps 1 to N), as shown in FIG. 2. After the aforesaid two circuits are integrated, the whole structure is bulky with a low economic efficiency in manufacturing.

Moreover, the conventional flash lamp circuit has many connecting wires in applications (such as used in application of loads) with less variations.

Therefore, there is an eager demand for a novel structure of a flash movable decorating lamp by which the defects in the prior art can be improved.

SUMMARY OF THE INVENTION

Accordingly, the primary object of the present invention is to provide a structure of a flash movable decorating lamp comprising at least one first unit and at least one second unit. Each of the first units is arranged with a high pressure converting circuit and an actuation circuit. Each second unit is installed with a movable decorating lamp flash circuit. The high pressure converting circuit and actuation circuit are connected to the movable decorating lamp flash circuit through connectors (or a bank of wires). As the present invention is used in different system with different voltage (AC or DC), it is only needed to update the high pressure converting circuit.

Another object of the present invention is to provide a structure of a flash movable decorating lamp, in which no screw is used in fixing, the flash -circuit board can be detached or attached conveniently.

A further object of the present invention is to provide a structure of a flash movable decorating lamp, wherein a serial system or a serial and parallel connection system with many variations can be formed by a plurality of first unit and a plurality of second unit.

The various objects and advantages of the present invention will be more readily understood from the following detailed description when read in conjunction with the appended drawing.

DETAILED DESCRIPTION OF THE PREFERRED EMBODIMENTS

Figure 1:
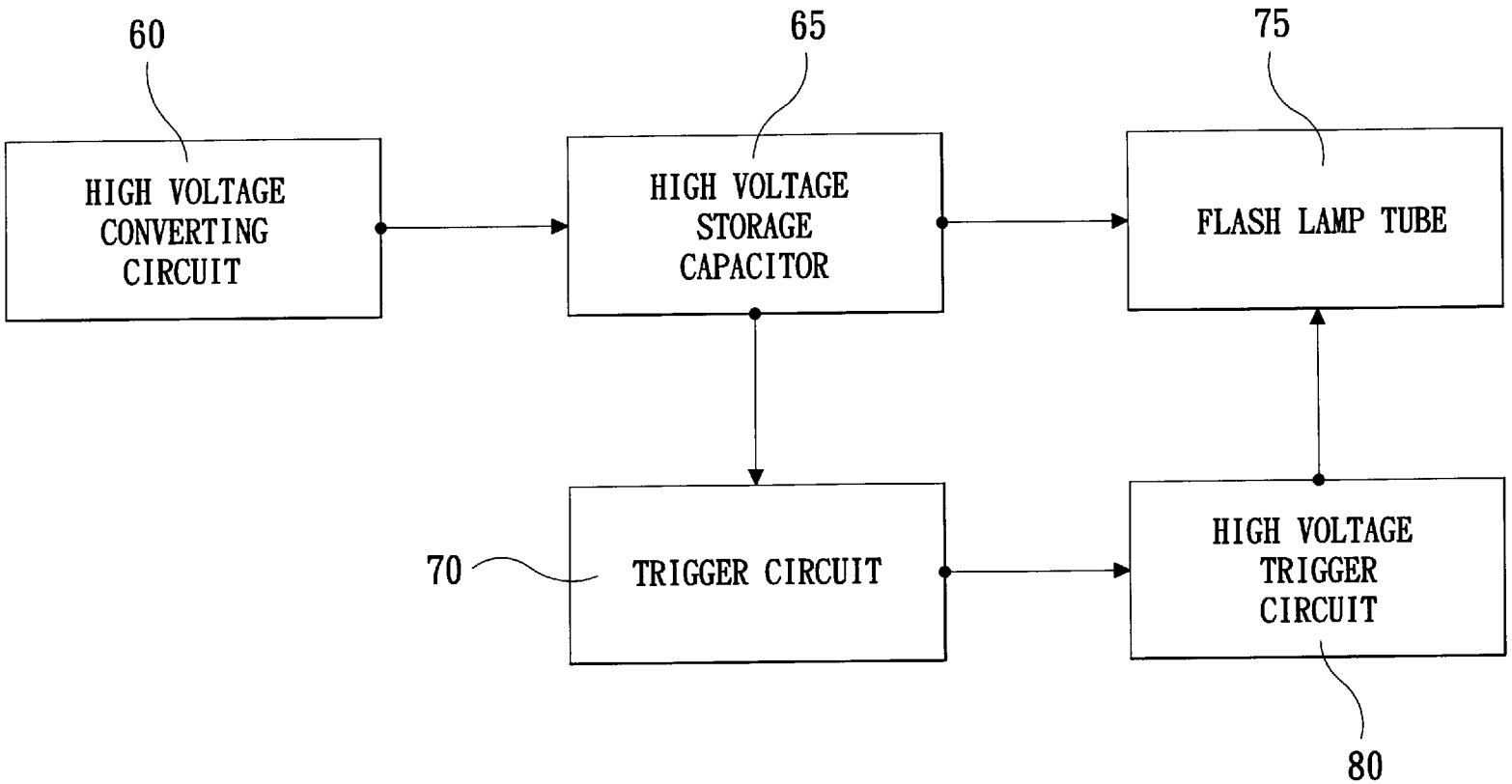
FIG. 1 PRIOR ART
FIG. 1 is a circuit block diagram of a prior art movable decorating lamp control circuit.
Figure 2:
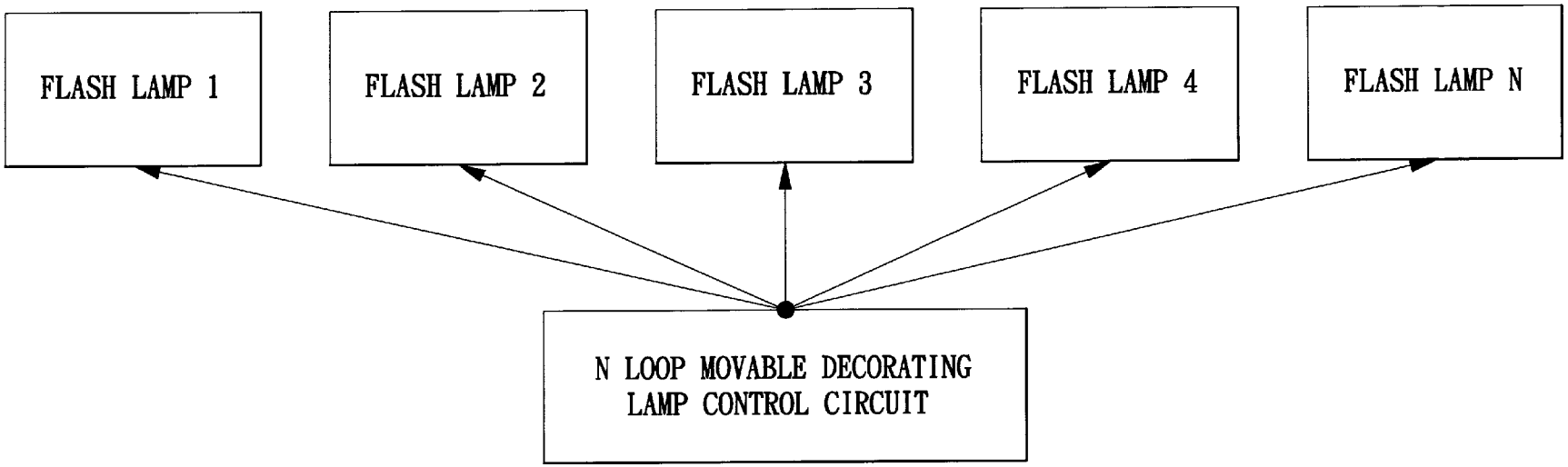
FIG. 2 PRIOR ART
FIG. 2 is a circuit diagram of a conventional flash movable decorating lamp.
Figure 3:
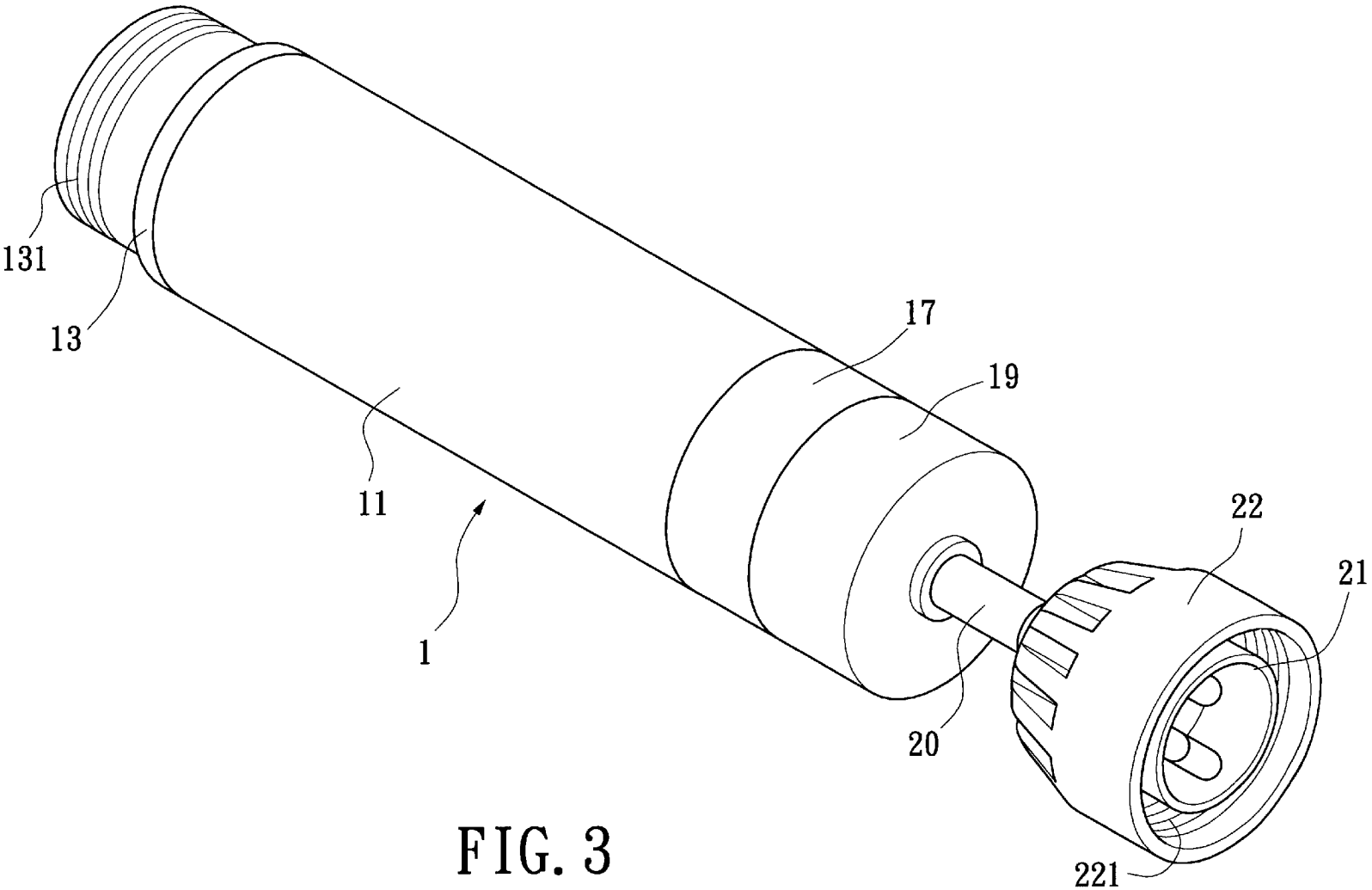
FIG. 3 is a perspective view of the first unit according to the present invention.
Figure 4:
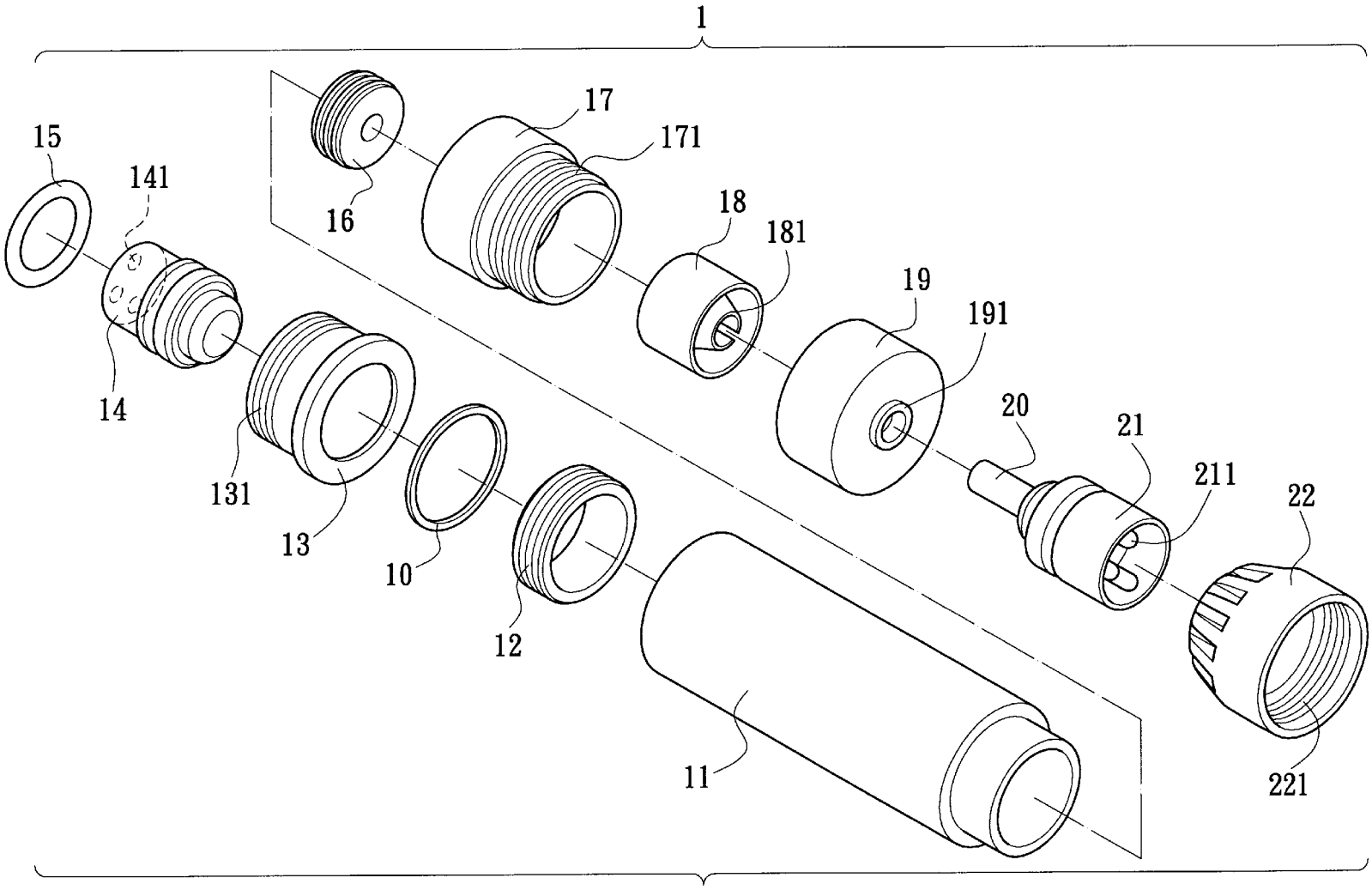
FIG. 4 is an exploded view of the first unit in the present invention.
Figure 5:
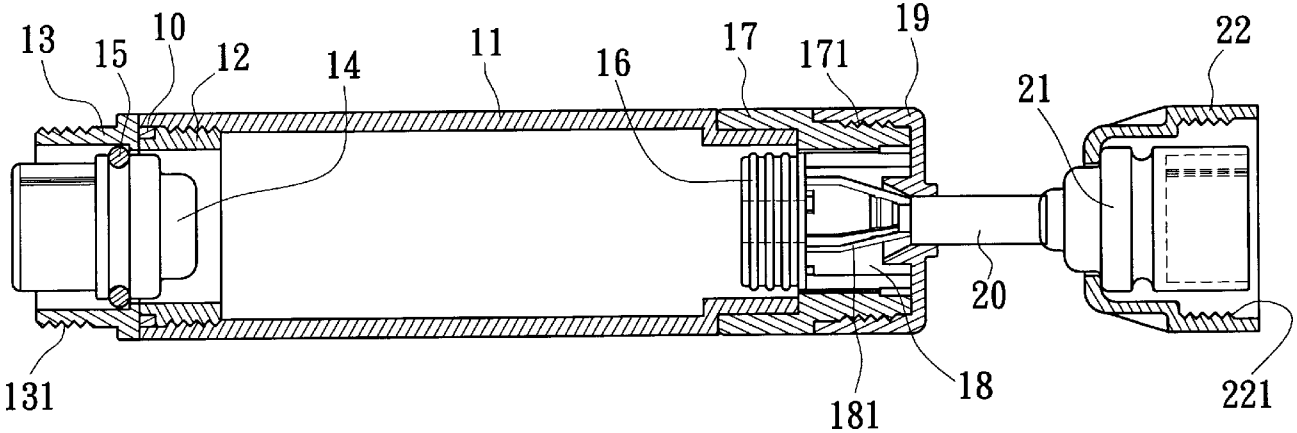
FIG. 5 is a cross sectional view of the first unit in the present invention.
Figure 6:
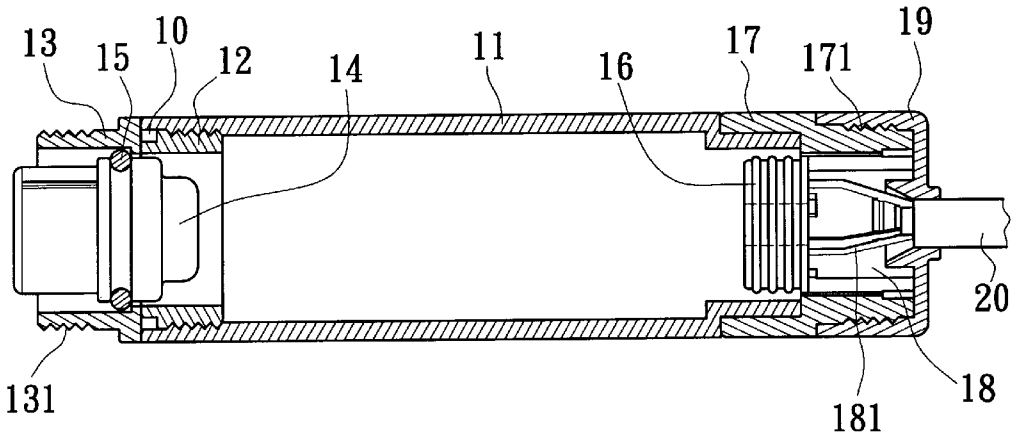
FIG. 6 is another cross sectional view of the first unit in the present invention.

With reference to FIGS. 3 to 7, a structure of a flash movable decorating lamp of the present invention is illustrated. The flash movable decorating lamp includes at least one first unit 1 and at least second unit 3.

Each of the first units 1 is installed with a hollow plastic tube 11. The hollow plastic tube 11 has substrate for a high voltage converting circuit and an actuating circuit (not shown). The plastic tube 11 has a rear opening. The inner surface thereof is screwedly connected to a stopping ring 12 and is connected to a plastic male threaded tube seat 13 by a rubber water-proof ring 10. The rear end of the plastic male threaded tube seat 13 has a round surface which is installed with an outer thread 131. A connector fixing seat 14 is connected to the plastic male threaded tube seat 13. A water-proof rubber ring 15 encloses the connector fixing seat 14. Some guide hole 141 is installed on the rear end surface of the connecting line fixing sleeve 14.

A male threaded tube seat 17, for assisting in positioning the plastic tube 11, is joined to the inner surface in from the opening of the plastic tube 11 through a rubber water-proof ring 16. A connecting line fixing sleeve 18 is installed within the male threaded tube seat 17. The central portion of the connecting line fixing sleeve 18 is formed with a tapered clamping portion 181. An outer thread 171 is formed on the round surface at the front end of the male threaded tube seat 17 for being threadedly connected with a female threaded tube seat 19. A via hole 191 is formed on the female threaded tube seat 191 for being embedded by a connecting line 20 so as to be combined with the clamping portion 181. The front end of the connecting line 20 is connected to the connector male seat 21. The front end of the connector male sweat 21 is connected to a plastic female threaded tube seat 22 for assisting in fixing the connector male seat 21. A plurality of inserting ends 211 are formed in the connector male seat 21. The inserting end 211 is connected to the respective connecting line 20. The front end of the plastic female threaded tube seat 22 has an inner surface being formed with an inner thread 221.

Figure 7:
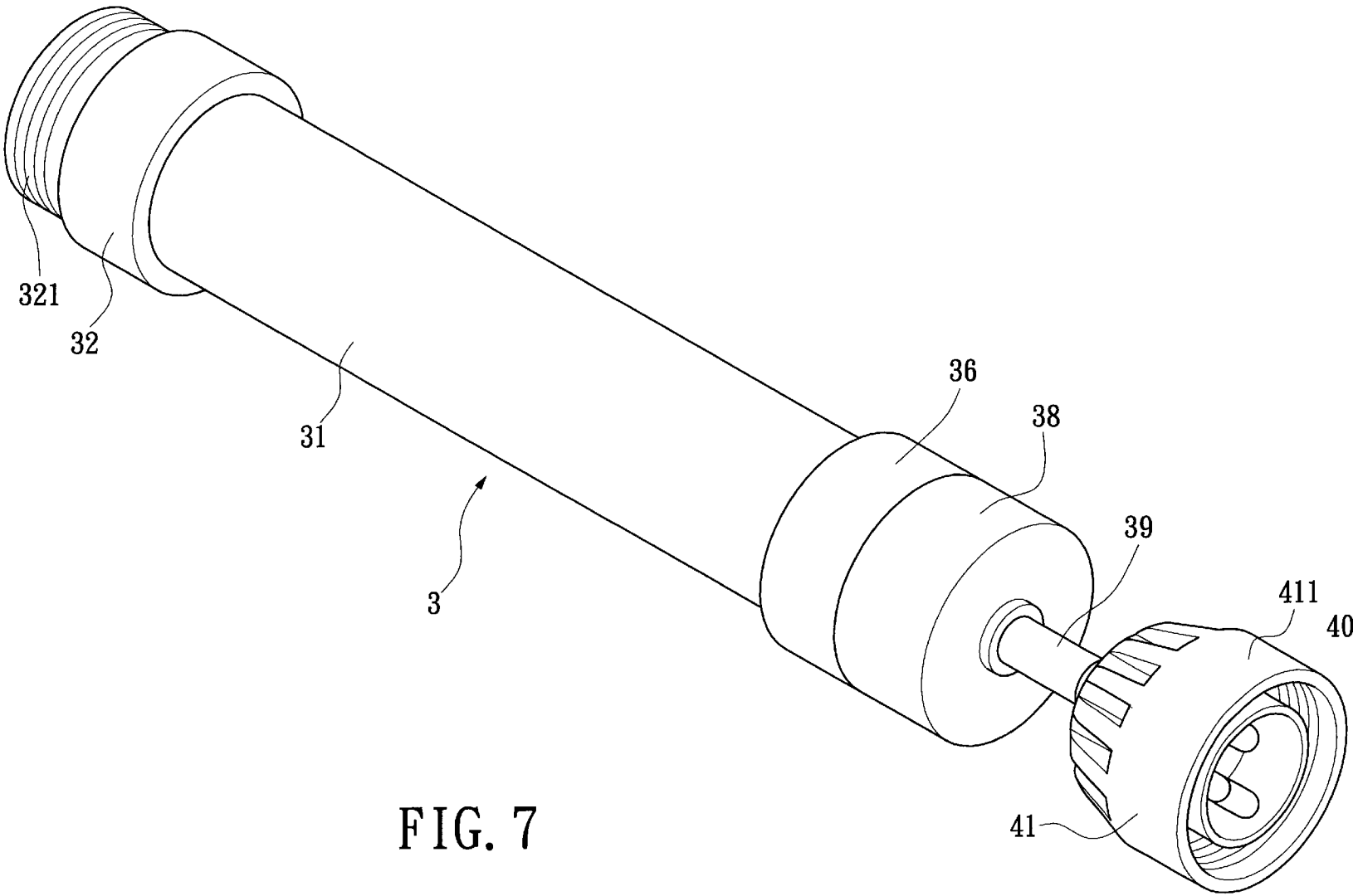
FIG. 7 is a perspective view of the second unit in the present invention.
Figure 8:
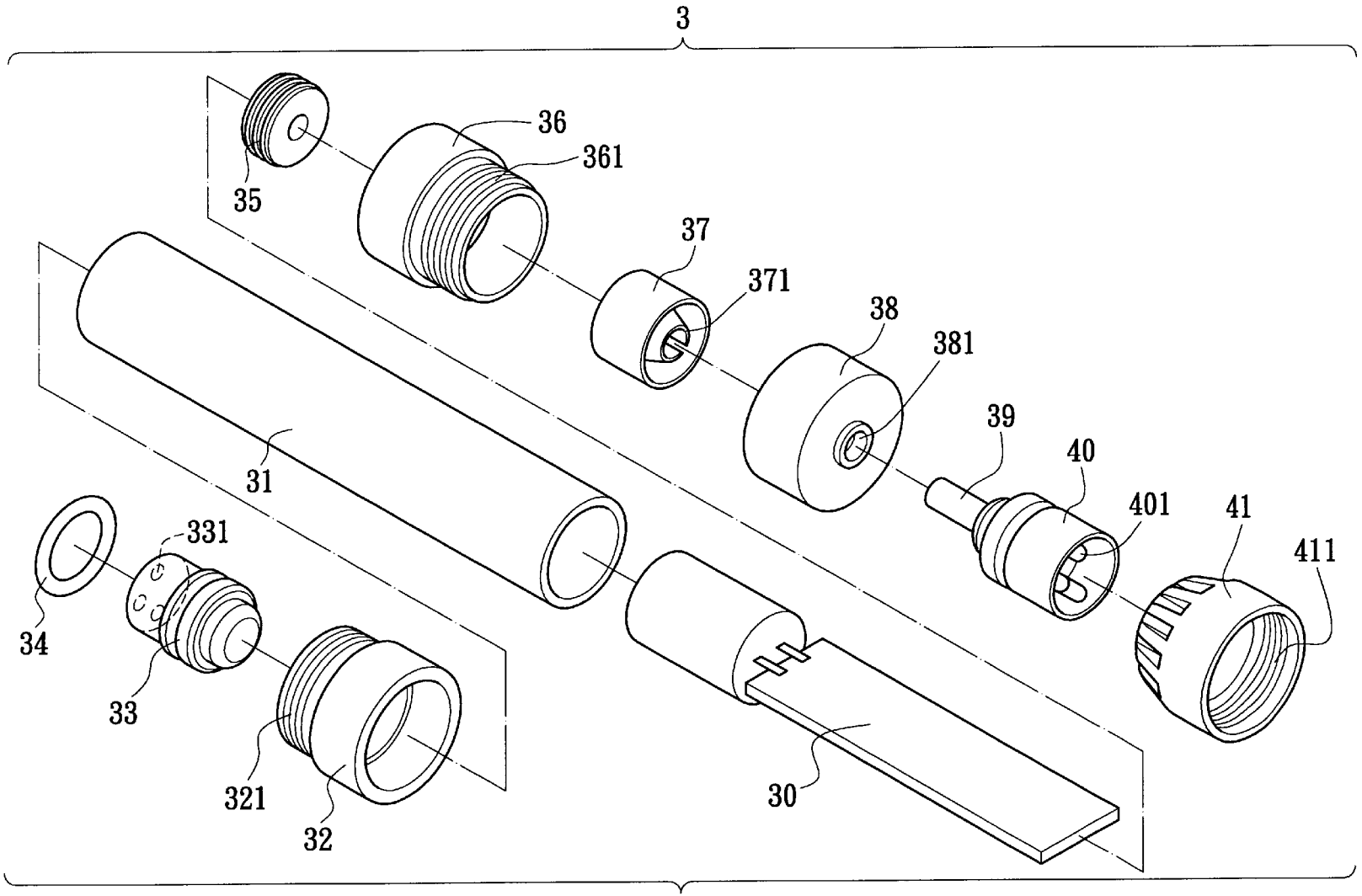
FIG. 8 is an exploded view of the second unit in the present invention.
Figure 9:
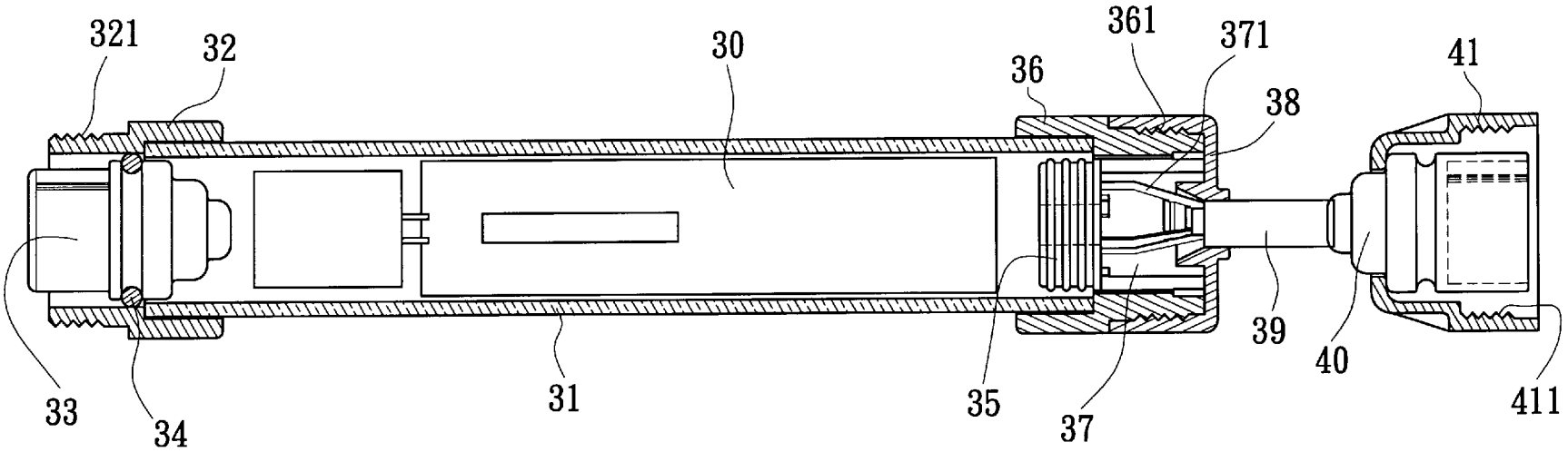
FIG. 9 is a cross sectional view of the second unit in the present invention.

Referring to FIGS. 7 to 9, the second unit 3 is installed with a round transparent tube 31. The transparent tube 31 is installed with a movable decorating lamp flash circuit board 30. The rear end of the transparent tube 31 have an outer round surface connected to the plastic male threaded tube seat 32. The round surface of the plastic male threaded tube seat 32 is installed with outer thread 321, and a connector fixing seat 33 is connected in the plastic male threaded tube seat 32. A water-proof rubber ring 34 covers on the connector fixing seat 33. The rear end surface of the connector fixing seat 33 is formed with a plurality of guide holes 331.

Further, the front opening of the transparent tube 31 has an inner surface being combined to a male threaded tube seat 36 for assisting in fixing the transparent tube 31 by the rubber water-proof ring 35. A connecting line fixing sleeve 37 is installed in the male threaded tube seat 36. A tapered clamping portion 371 is formed on the central portion of the connecting line fixing sleeve 37. The round surface in the front end of the male threaded tube seat 36 is formed with outer thread 361 for being screwedly connected with a female threaded tube seat 38. A via hole 381 is formed in the female threaded tube seat 38 for being embedded by a connecting line 39 so as to be combined with the clamping portion 371. The front end of the connecting line 39 is connected to a connector male seat 40. The front end of the connector male seat 40 is connected to a plastic female threaded tube seat 41 for assisting in fixing the connector male seat 40. A plurality of inserting ends 401 are installed in the connector male seat 40. Each inserting end 401 is connected with a respective connecting line 39. The inner surface of the front end of the plastic female threaded tube seat 41 is formed with an inner thread 411.

Thereby, the high voltage converting circuit and the actuation circuit in the first unit 1 is connected to the movable decorating lamp flash circuit of the second unit 3 through connectors (including connector male seat 21 and connector fixing seat 33). When it is used in different condition with different voltage (AC or DC), it is only necessary to update the high voltage converting circuit.

Figure 10:
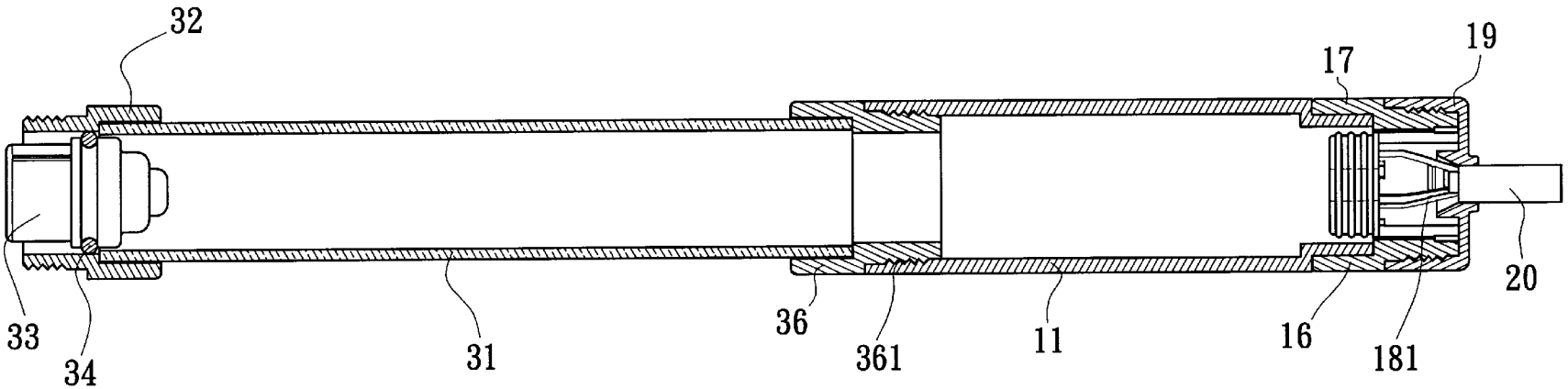
FIG. 10 is cross sectional view showing the assembly of the first unit and second unit in the present invention.

With reference to FIG. 10, a cross sectional view showing the assembly of the first unit and the second unit of the present invention is illustrated, wherein the outer thread 361 of the screw tube seat 38 in the second unit 3 is screwedly connected to the opening at rear end of the plastic tube 11 in the first unit 1.

Figure 11:
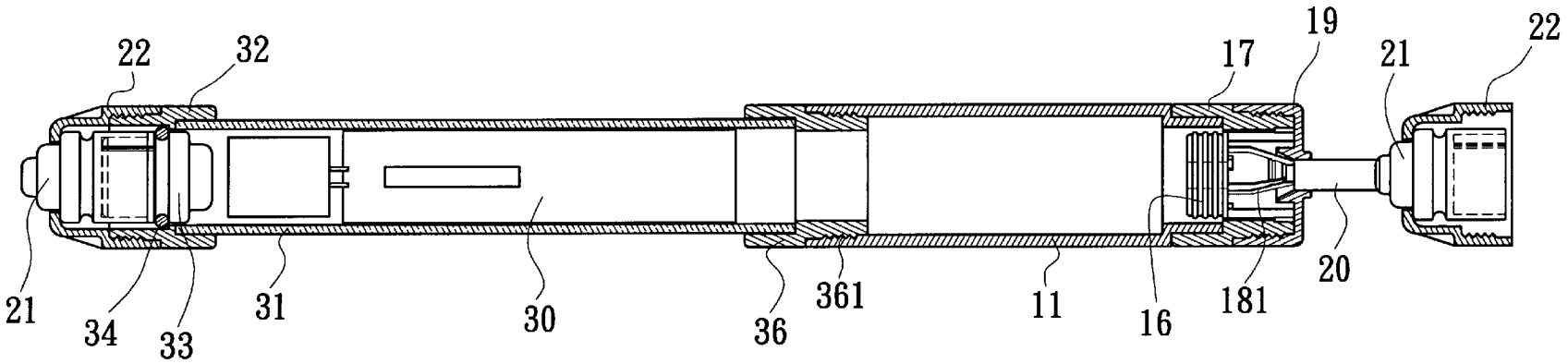
FIG. 11 is a cross sectional view of an assembled unit.

Referring to FIG. 11, an embodiment showing an application of the present invention is illustrated. Two ends of the second unit 3 is connected to the first unit 1. Thereby, a serial connecting system with many variations is formed. Besides, in application, the present invention can be connected in series or in parallel or alternatively arranged by serial and parallel connections to achieve a complex configuration. Namely, the serial connection and serial and parallel connections are described in the following (A represents the first unit. and B represents second unit):

Serial connection:

A+B; or

A+B+B+B+ . . . ; or

A+B+A+B+B+A+B+ . . .

Serial and parallel connection:

A+B+B . . . and

+B+B+B . . . and

+B+B+B+A and

+B+B . . .

In summary, the present invention has the following advantages:

1. No screw is used in fixing, the flash circuit board can be detached or attached conveniently.
2. Less wires are necessary.
3. An independent system can be assembled by a single first unit and a single second unit.
4. A serial or a serial and parallel connection system with many variations can be formed by a plurality of first units and a plurality of second units.

Although the present invention has been described with reference to the preferred embodiments. it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A structure of a flash movable decorating lamp comprising:

at least one first unit, each first unit being a hollow tube having a high pressure converting circuit and an actuation circuit therein; a rear end of the tube being connected to a first threaded tube seat; the round surface at a rear end of the first threaded tube seat being formed with an outer thread; a connector fixing seat being combined within the first threaded tube seat; a rear end of the connector fixing seat being installed with a guiding hole and a front end of the tube being combined to a second threaded tube seat; a connecting line fixing sleeve being installed in the second threaded tube seat; a clamping portion being disposed in the connecting line fixing sleeve; a front end of the second threaded tube seat installed with an outer thread for being combined by a third threaded tube seat; a via hole being formed in the third threaded tube seat for being embedded by a connecting line to be combined with the clamping portion; a front end of the connecting line being combined to a connector seat; an inserting end being installed within the connector seat; the inserting end being connected to the respective connecting line and a front end of the connector seat being combined to a fourth thread tube seat; and an inner thread being formed at a front end of the fourth thread tube seat; and at least one second unit; each second unit being installed with a transparent tube used for the structure of a flash movable decorating lamp; a rear end of the transparent tube being combining to a fifth thread tube seat; a rear end of the fifth thread tube seat being installed with an outer thread and a connector fixing seat being combined in the fifth thread tube seat; a rear end of the connector fixing seat being installed with guide hole, while at a front end of the transparent tube being combined to a sixth thread tube seat; a connecting line fixing sleeve being installed in the sixth thread tube seat; a clamping portion being disposed in the connecting line fixing sleeve; a front end of the sixth thread tube seat being installed with outer thread for being combined to a seventh thread tube seat; a via hole being formed on the seventh thread tube seat for being embedded by a connecting line so as to be combined to the clamping portion; a front end of the connecting line being combined to a connector seat; an inserting end being formed in the connector seat which is connected to a respective connecting line and a front end of the connector seat being connected to an eighth thread tube seat, and a front end of the eighth thread tube seat being formed with inner thread;

wherein by a structure formed by aforesaid components, a structure of a flash movable decorating lamp is formed, by which, a flash circuit can be detachably attached to form any of a plurality of connections selected from the group consisting of serial connections, and combinations of serial and parallel connections.

2. A structure of a flash movable decorating lamp as claimed in claim 1, wherein a water-proof rubber ring covers on the connector fixing seat of the first unit.

3. A structure of a flash movable decorating lamp as claimed in claim 1, wherein a stopping ring is disposed at an opening of a rear end of the first unit.

4. A structure of a flash movable decorating lamp as claimed in claim 1, wherein a water-proof rubber ring covers on the connector fixing seat of the second unit.

5. A structure of a flash movable decorating lamp as claimed in claim 1, wherein two ends at the tube body of the first unit are connected to a respective thread tube seat by respective rubber water-proof rings.

6. A structure of a flash movable decorating lamp as claimed in claim 1, wherein two ends of the transparent tube in the second unit are connected to a respective thread tube seat by respective rubber water-proof rings.

7. A structure of a flash movable decorating lamp as claimed in claim 1, wherein the high pressure converting circuit and actuation circuit in the hollow tube are directly connected to the movable decorating lamp flash circuit in the transparent tube.

* * * * *